US008123867B2

(12) United States Patent
Tropsch

(10) Patent No.: US 8,123,867 B2
(45) Date of Patent: Feb. 28, 2012

(54) PHOSPHATE-FREE DISHWASHER DETERGENT WITH EXCELLENT RINSING POWER

(75) Inventor: Juergen Tropsch, Roemerberg (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 12/597,109

(22) PCT Filed: Apr. 24, 2008

(86) PCT No.: PCT/EP2008/055004

§ 371 (c)(1),
(2), (4) Date: Aug. 13, 2010

(87) PCT Pub. No.: WO2008/132133

PCT Pub. Date: Nov. 6, 2008

(65) Prior Publication Data

US 2010/0294309 A1 Nov. 25, 2010

(30) Foreign Application Priority Data

Apr. 25, 2007 (DE) ..... 10 2007 019 458

(51) Int. Cl.

| | |
|---|---|
| ***B08B 3/04*** | (2006.01) |
| ***C11D 1/72*** | (2006.01) |
| ***C11D 1/825*** | (2006.01) |
| ***C11D 3/20*** | (2006.01) |
| ***C11D 3/33*** | (2006.01) |
| ***C11D 3/37*** | (2006.01) |

(52) U.S. Cl. ..... 134/25.2; 134/25.3; 134/39; 134/42; 510/220; 510/229; 510/421; 510/434; 510/475; 510/477; 510/488; 510/506; 510/524; 510/533

(58) Field of Classification Search ..... 510/220, 510/229, 421, 434, 475, 477, 488, 506, 524, 510/533; 134/25.2, 25.3, 39, 42
See application file for complete search history.

(56) References Cited

U.S. PATENT DOCUMENTS

| | | | | |
|---|---|---|---|---|
| 5,981,455 | A * | 11/1999 | Carrie et al. | 510/218 |
| 6,521,576 | B1 | 2/2003 | Ghatlia et al. | |
| 2002/0183222 | A1 * | 12/2002 | Foley et al. | 510/218 |
| 2005/0101516 | A1 | 5/2005 | Kieffer et al. | |
| 2008/0188391 | A1 | 8/2008 | Seebeck, et al. | |

FOREIGN PATENT DOCUMENTS

| | | | |
|---|---|---|---|
| DE | 101 17 273 | A1 | 10/2002 |
| DE | 102 33 834 | | 2/2004 |
| DE | 10 2005 041 349 | | 3/2007 |
| EP | 0 616 028 | | 9/1994 |
| EP | 0 877 002 | | 11/1998 |
| EP | 1 524 313 | | 4/2005 |
| WO | WO 99/16775 | | 4/1999 |
| WO | 00 50551 | | 8/2000 |
| WO | WO 02/08374 | * | 1/2002 |
| WO | 02 20708 | | 3/2002 |
| WO | 2005 047440 | | 5/2005 |

OTHER PUBLICATIONS

U.S. Appl. No. 12/063,036, filed Feb. 6, 2008, Seebeck, et al.
U.S. Appl. No. 12/596,946, filed Oct. 21, 2009, Tropsch.
U.S. Appl. No. 12/783,726, filed May 20, 2010, Seebeck, et al.
U.S. Appl. No. 12/783,804, filed May 20, 2010, Seebeck, et al.

* cited by examiner

*Primary Examiner* — Brian P Mruk
(74) *Attorney, Agent, or Firm* — Oblon, Spivak, McClelland, Maier & Neustadt, L.L.P.

(57) ABSTRACT

The present invention relates to a phosphate-free machine dishwasher detergent comprising 0.01-20% by weight of at least one alcohol alkoxylate, 0.01-10% by weight of at least one alcohol ethoxylate, 0-15% by weight of at least one sulfonate-containing polymer, 0-15% by weight of at least one hydrophilically modified polycarboxylate, 0-8% by weight of at least one polycarboxylate, 1-50% by weight of at least one complexing agent and 0.1-60% by weight of at least one further additive, where the sum of components (A), (B), (C), (D), (E), (F) and (G) is 100% by weight, to a process for rinsing surfaces of articles by treating these surfaces with the composition, and to the use of the composition for increasing the rinsing performance in the machine washing of articles.

14 Claims, No Drawings

PHOSPHATE-FREE DISHWASHER DETERGENT WITH EXCELLENT RINSING POWER

The present invention relates to a phosphate-free machine dishwasher detergent comprising an alcohol alkoxylate, an alcohol ethoxylate, at least one polymer, at least one complexing agent and further additives, to a process for rinsing surfaces, and to the use of the phosphate-free machine dishwasher detergent for increasing the rinsing performance in the machine washing of articles, especially dishes, glasses, cutlery and kitchen accessories.

Currently, 3-in-1 dishwasher detergents have a European market share among machine dishware cleaners of approx. 60%. They combine the three functions of cleaning, rinsing and softening in one dishwasher detergent. Machine dishwasher detergents are already known from the prior art.

EP 0 877 002 B1 discloses a process for controlling the amount of (poly)phosphates by treating aqueous systems with at least one copolymer comprising, as monomers, at least one weak acid, at least one unsaturated sulfonic acid, optionally at least one monoethylenically unsaturated $C_4$-$C_8$-dicarboxylic acid and optionally at least one unsaturated monomer which is polymerizable with the aforementioned compounds.

WO 00/50551 discloses a formulation for dishwashing, comprising a builder, a nonionic surface-active substance, bleaching compounds and further additives selected from enzymes, surfactants or gelating compounds.

DE 102 33 834 A1 discloses dishwasher detergents for the machine cleaning of dishes, comprising builders, polymers and surfactants. The nonionic surfactants used may be primary alcohols, for example trimethylolpropane, alkoxylated with propylene oxide and ethylene oxide.

While the cleaning performance of known 3-in-1 dishwasher detergents is adequate, the rinsing performance especially in the case of hardnesses of more than 14° dH is an unsolved problem. Sufficient rinsing performance is moreover difficult to achieve if the dishwasher detergent is phosphate-free.

It has been found that, surprisingly, the use of a combination of different components, comprising at least one alcohol alkoxylate, at least one short-chain alcohol ethoxylate, at least one sulfonate-containing polymer and/or at least one hydrophilically modified polycarboxylate, optionally a polycarboxylate, and at least one complexing agent together with generally customary other constituents, can significantly improve the rinsing performance even in the case of significantly higher water hardness and in the absence of phosphates.

It is an object of the present invention to increase the rinsing performance of phosphate-free 3-in-1 dishwasher detergents in dishwashing.

It is a further object of the present invention to increase the rinsing performance of phosphate-free 3-in-1 dishwasher detergents at water hardnesses of more than 14° dH.

This object is achieved by a phosphate-free machine dishwasher detergent comprising (A) 0.01-20% by weight of at least one alcohol alkoxylate of the general formula (I)

$$R^1—(OCH_2CHR^2)_x(OCH_2CHR^3)_y—OR^4 \quad (I)$$

where $R^1$: linear or branched $C_6$-$C_{24}$-alkyl radical, $R^2$, $R^3$: different and each independently hydrogen, linear or branched $C_1$-$C_6$-alkyl radical, $R^4$: hydrogen, linear or branched $C_1$-$C_8$-alkyl radical, x, y: each independently mean value in the range of 0.5-80, where the individual alkylene oxide units may be present as a block or in random distribution, (B) 0.01-10% by weight of at least one alcohol ethoxylate of the general formula (II)

$$R^5—(OCH_2CH_2)_zOH \quad (II)$$

where $R^5$: linear or branched $C_4$-$C_8$-alkyl radical and z: mean value of 2-10, where the content of residual alcohol $R^5$—OH is less than 1% by weight, (C) 0-15% by weight of at least one sulfonate-containing polymer, (D) 0-15% by weight of at least one hydrophilically modified polycarboxylate, (E) 0-8% by weight of at least one polycarboxylate, (F) 1-40% by weight of at least one complexing agent and (G) 0.1-60% by weight of at least one further additive, where the sum of components (A), (B), (C), (D), (E), (F) and (G) is 100% by weight.

In a preferred embodiment, the inventive phosphate-free dishwasher detergent consists of components (A), (B), (F), (G) and optionally (C), (D) and (E).

The use of components selected from at least one alcohol alkoxylate (A), at least one short-chain alcohol ethoxylate (B), at least one sulfonate-containing polymer (C) and/or a hydrophilically modified polycarboxylate (D), which inhibit the formation of calcium phosphate deposits, and optionally a polycarboxylate which inhibits the formation of calcium carbonate deposits, in conjunction with at least one complexing agent and at least one further additive can significantly improve the rinsing performance of the inventive dishwasher detergents even at significantly higher water hardness and in the absence of phosphates.

In the context of the present invention the term "phosphate-free" means that in the inventive dishwasher detergent there is less than 0.1%, preferably less than 0.01%, more preferably 0% of phosphates.

Under the term "phosphates" the invention means compounds which have the anion $PO_4^{3-}$, individually or as a structural unit of a higher order, so-called polyphosphates, and in which the phosphorus atom is attached exclusively to oxygen atoms and is present in the oxidation state +V.

In addition to the outstanding rinsing performance of the inventive dishwasher detergent, it is notable, on the basis of the absence of phosphates, for its very good biocompatibility as well.

The ingredients (A), (B), (C), (D), (E), (F) and (G) of the phosphate-free machine dishwasher detergent are explained in detail hereinafter.

Component (A)

The phosphate-free machine dishwasher detergent comprises, as component (A), 0.01 to 20% by weight, preferably 0.5 to 15% by weight, more preferably 1 to 10% by weight, of at least one alcohol alkoxylate of the general formula (I)

$$R^1—(OCH_2CHR^2)_x(OCH_2CHR^3)_y—OR^4 \quad (I)$$

where $R^1$: linear or branched $C_6$-$C_{24}$-alkyl radical, $R^2$, $R^3$: different and each independently hydrogen, linear or branched $C_1$-$C_6$-alkyl radical, $R^4$: hydrogen, linear or branched $C_1$-$C_8$-alkyl radical and x, y: each independently mean value in the range of 0.5-80, where the individual alkylene oxide units may be present as a block or in random distribution.

The $R^1$ radical in the alcohol alkoxylate of the general formula (I) is generally a linear or branched $C_6$- to $C_{24}$-alkyl radical, preferably a linear or branched $C_8$ to $C_{18}$-alkyl radical, more preferably a linear or branched $C_9$- to $C_{15}$-alkyl radical.

The alkylene oxide blocks ($OCH_2CHR^2$) and ($OCH_2CHR^3$) represent structural units which are obtained by alkoxylation of the alcohols $R^1$—OH with a compound selected from the group consisting of ethylene oxide, propylene oxide, butylene oxide, pentene oxide, hexylene oxide, heptylene oxide, octylene oxide, nonylene oxide, decylene oxide and mixtures thereof, preferably selected from the group consisting of ethylene oxide, propylene oxide, butylene oxide, pentene oxide and mixtures thereof. The reaction with the different alkylene oxides can be performed in blocks (successively or alternately) or simultaneously (random or mixed method). Thus, the $R^2$ and $R^3$ radicals in the general formula (I) are different and are each independently hydrogen or a $C_1$- to $C_6$-alkyl radical, preferably hydrogen or a $C_1$- to $C_3$-alkyl radical, i.e. are each independently hydrogen, methyl, ethyl or propyl.

$R^3$ in the general formula (I) is hydrogen, linear or branched $C_1$- to $C_8$-alkyl radical, preferably hydrogen or linear or branched $C_1$- to $C_4$-alkyl radical, more preferably hydrogen, methyl or ethyl.

In the general formula (I), x describes the number of ($OCH_2CHR^2$) units, and y describes the number of ($OCH_2CHR^3$) units. In the compounds of the general formula (I), x and y each independently have a mean value of 0.5 to 80, preferably 0.5 to 40, more preferably 0.5 to 20. When x describes the number of ethylene oxide units present in the alcohol alkoxylate of the general formula (I), x has a mean value of 2 to 20, preferably 2 to 15. When y in the alcohol alkoxylate of the general formula (I) describes the number of propylene oxide, butylene oxide or pentene oxide units, y has a mean value of 0.5 to 20, preferably 0.5 to 10, more preferably 0.5 to 6.

The values x and y in the general formula (I) constitute mean values since the alkoxylation of alcohols generally provides a distribution of the degree of alkoxylation. x and y may therefore deviate from integer values. The distribution of the degree of alkoxylation can be adjusted to a certain degree by use of different alkoxylation catalysts. Since at least one longer-chain alkylene oxide is also used as well as ethylene oxide, the different alkylene oxide structural units may be in random distribution, alternate or be in the form of two or more blocks in any sequence. The mean of the homolog distribution is represented by the numbers x and y specified.

In a preferred embodiment, in component (A), $R^1$ is a linear or branched $C_8$-$C_{18}$-alkyl radical, $R^2$ and $R^3$ are each independently hydrogen, methyl, ethyl or propyl, and x and y each independently have a mean value from 0.5 to 20.

Most preferably, the compounds of the general formula (I) used are the following:

- $C_{13}$ to $C_{15}$ oxo alcohol+10 units of ethylene oxide+2 units of butylene oxide,
- iso-$C_{10}$-alcohol+10 units of ethylene oxide+1.5 units of pentene oxide,
- $C_{10}$ to $C_{12}$ fatty alcohol+9 units of ethylene oxide+5 units of propylene oxide,
- $C_{13}$ to $C_{15}$ oxo alcohol+4.46 units of ethylene oxide+0.86 units of butylene oxide, end-capped with a methyl group,
- 2-propylheptanol+6 units of ethylene oxide+4.5 units of propylene oxide or mixtures thereof.

The inventive compounds of the general formula (I) are obtained, for example, by alkoxylation of alcohols of the general formula $R^1$—OH with alkylene oxides which give rise to the ($OCH_2CHR^2$) and ($OCH_2CHR^3$) units in the general formula (I). When the $R^4$ radical is not hydrogen, the alkoxylation can be followed by an etherification, for example with dimethyl sulfate.

The alkoxylation can be performed, for example, using alkaline catalysts such as alkali metal hydroxides or alkali metal alkoxides. The use of these catalysts results in specific properties, especially the homolog distribution of the alkylene oxides.

The alkoxylation can additionally be performed using Lewis-acidic catalysis with the specific properties resulting therefrom, especially in the presence of $BF_3 \times H_3PO_4$, $BF_3 \times$ dietherate, $BF_3$, $SbCl_5$, $SnCl_4 \times 2\ H_2O$, hydrotalcite. Suitable catalysts are also double metal cyanide (DMC) compounds.

The excess alcohol can be distilled off, or the alkoxylate can be obtained by a two-stage process. The preparation of mixed alkoxylates from, for example, ethylene oxide (EO) and propylene oxide (PO) is also possible, in which case the alcohol radical may be adjoined first by a propylene oxide block and then by an ethylene oxide block, or first by an ethylene oxide block and then by a propylene oxide block. Random distributions are also possible. Preferred reaction conditions are specified below.

The alkoxylation is preferably catalyzed by strong bases, which are appropriately added in the form of an alkali metal hydroxide or alkaline earth metal hydroxide, generally in an amount of 0.1 to 1% by weight, based on the amount of the alcohol $R^1$—OH (cf. G. Gee et al., J. Chem. Soc. (1961), p. 1345; B. Wojtech, Makromol. Chem. 66 (1966), p. 180).

Acidic catalysis of the addition reaction is also possible. As well as Brönsted acids, Lewis acids such as aluminum trichloride or $BF_3$ are also suitable (cf. P. H. Plesch, The Chemistry of Cationic Polymerization, Pergamon Press, New York (1963)).

The alkoxylation can also be performed by means of double metal cyanide catalysts by methods known to those skilled in the art. The double metal cyanide compounds used may in principle be all suitable compounds known to those skilled in the art. DMC compounds suitable as catalysts are described, for example, in WO 99/16775 and in DE-A-10117273.

The addition reaction is performed at temperatures of about 90 to about 240° C., preferably of 120 to 180° C., in a closed vessel. The alkylene oxide or the mixture of different alkylene oxides is supplied to the mixture of inventive alcohol or alcohol mixture and alkali under the vapor pressure of the alkylene oxide mixture which exists at the selected reaction temperature. If desired, the alkylene oxide can be diluted with up to about 30 to 60% of an inert gas. This gives additional safety by counteracting explosive polyaddition or decomposition of the alkylene oxide. When an alkylene oxide mixture is used, polyether chains in which the different alkylene oxide units are in virtually random distribution are formed. Variations in the distribution of the units along the polyether chain arise owing to different reaction rates of the components and can also be introduced arbitrarily by continuous supply of an alkylene oxide mixture of program-controlled composition. When the different alkylene oxides are reacted in succession, polyether chains with block distribution of the alkylene oxide units are obtained.

Component (B)

The phosphate-free machine dishwasher detergent comprises, as component (B), 0.01 to 10% by weight, preferably 0.1 to 5% by weight, more preferably 0.1 to 2% by weight, of an alcohol ethoxylate of the general formula (II)

$$R^5—(OCH_2CH_2)_zOH \quad (II)$$

where $R^5$: linear or branched $C_2$-$C_{10}$-alkyl radical and z: mean value of 2-10, where the content of residual alcohol $R^5$—OH is less than 1% by weight, preferably less than 0.5% by weight, more preferably less than 0.2% by weight.

In the alcohol ethoxylate of the general formula (II), $R^5$ is a linear or branched $C_2$-$C_{10}$-alkyl radical, preferably $C_4$-$C_8$-alkyl radical.

In the general formula (II), z is a mean value from 2 to 10, preferably 3 to 8, more preferably 4 to 6. With regard to the mean value of z, the same statements apply as already made for x and y in component (A).

Component (B) is a linear or branched $C_4$-$C_8$-alcohol which has been alkoxylated with 2 to 10 units of ethylene oxide. The alcohol ethoxylate of the general formula (II) can be prepared as per the preparation of the alcohol alkoxylate of the general formula (I), though it should be noted that the alkylene oxide used is exclusively ethylene oxide. With regard to the catalysis too, the same statements apply as for the alcohol alkoxylate of the general formula (I).

To prepare the alcohol ethoxylates of the general formula (II), it is also possible to use alkylglycol alkoxylates or -diglycol alkoxylates which are obtainable by alkoxylating corresponding $C_4$-$C_8$-alkylglycols or -diglycols with ethylene oxide, preferably up to a mean degree of alkoxylation which corresponds to the aforementioned compounds of the general formula (II).

The preparation here proceeds from the corresponding alcohol-free, preferably pure, alkylglycols and alkyldiglycols, and not, as described above, from alcohols, by alkoxylation. The product mixtures therefore do not comprise any remaining alcohols either, but rather at most alkylglycols. This gives rise to a distribution of the degree of alkoxylation which is specific for alkylglycols. By virtue of this preparation process, it is possible that the alcohol ethoxylates of the general formula (II) have a content of residual alcohol $R^5$—OH of less than 1% by weight, preferably less than 0.5% by weight, more preferably less than 0.2% by weight.

When the alcohol ethoxylates of the general formula (II) are prepared by ethoxylating the corresponding alcohols $R^5$—OH, the residual alcohol $R^5$—OH present in the mixture after the ethoxylation can be removed by processes known to those skilled in the art, for example distillation.

Specifically the presence of component (B) in the inventive machine dishwasher detergent significantly increases the rinsing performance at elevated water hardness above 14° dH.

Component (C)

The phosphate-free machine dishwasher detergent comprises, as component (C), 0 to 15% by weight, preferably 0.5 to 12% by weight, more preferably 1 to 10% by weight of at least one sulfonate-containing polymer/copolymer. This at least one sulfonate-containing polymer/copolymer prevents the formation of deposits which consist of calcium phosphate.

In a preferred embodiment, the inventive dishwasher detergent comprises at least one copolymer C comprising the following monomers (I) 50-98% by weight of one or more weak acids, (II) 2-50% by weight of one or more unsaturated sulfonic acid monomers selected from the group consisting of 2-acrylamidomethyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 3-sulfopropyl methacrylate, sulfomethylacrylamide, sulfomethylmethacrylamide and water-soluble salts thereof, (III) 0-30% by weight of one or more monoethylenically unsaturated $C_4$-$C_8$-dicarboxylic acids and (IV) 0-30% by weight of one or more monoethylenically unsaturated monomers polymerizable with (I), (II) and (III), where the entirety of monomers (I), (II), (III) and (IV) corresponds to 100% by weight of the copolymer.

In a particularly preferred embodiment, the copolymer C comprises the following monomers in polymerized form:

(I) 50-98% by weight of one or more ethylenically unsaturated $C_3$-$C_6$-monocarboxylic acids, (II) 2-50% by weight of one or more unsaturated sulfonic acids, (III) 0-30% by weight of one or more monoethylenically unsaturated $C_4$- to $C_8$-dicarboxylic acids and (IV) 0-30% by weight of one or more monoethylenically unsaturated monomers polymerizable with (I), (II) and (III), where the entirety of monomers (I), (II), (III) and (IV) corresponds to 100% by weight of the copolymer.

In an especially preferred embodiment, the copolymer C comprises polymerized units of the following units:

(I) 50-90% by weight of one or more ethylenically unsaturated $C_3$-$C_6$-monocarboxylic acids, (II) 10-50% by weight of unsaturated sulfonic acid, (III) 0-30% by weight of one or more monoethylenically unsaturated $C_4$-$C_8$-dicarboxylic acids and (IV) 0-30% by weight of one or more monoethylenically unsaturated monomers polymerizable with (I), (II) and (III), where the entirety of monomers (I), (II), (III) and (IV) corresponds to 100% by weight of the copolymer.

In a very particularly preferred embodiment, the copolymer (C) comprises polymerized units of the following monomers:

(I) 60-90% by weight of one or more ethylenically unsaturated $C_3$-$C_6$-monocarboxylic acids, (II) 10-40% by weight of the unsaturated sulfonic acid, (III) 0-30% by weight of one or more monoethylenically unsaturated $C_4$-$C_8$-dicarboxylic acids and (IV) 0-30% by weight of one or more monoethylenically unsaturated monomers polymerizable with (I), (II) and (III), where the entirety of monomers (I), (II), (III) and (IV) corresponds to 100% by weight of the copolymer.

A copolymer C with particularly good properties for use in dishwasher detergents comprises polymerized units of the following monomers:

(I) 77% by weight of one or more ethylenically unsaturated $C_3$-$C_6$-monocarboxylic acids, (II) 23% by weight of the unsaturated sulfonic acid, where the unsaturated $C_3$-$C_6$-monocarboxylic acid is preferably (meth)acrylic acid.

The monoethylenically unsaturated $C_4$-$C_8$-dicarboxylic acid is preferably maleic acid, and the monoethylenically unsaturated monomer polymerizable with (I), (II) and (III) is preferably selected from one or more of $C_1$-$C_4$-alkyl esters of (meth)acrylic acid, $C_1$-$C_4$-hydroxyalkyl esters of (meth) acrylic acid, acrylamide, alkyl-substituted acrylamide, N,N-dialkyl-substituted acrylamides, sulfonated alkylacrylamides, vinylphosphonic acids, vinyl acetate, allyl alcohols, sulfonated allyl alcohols, styrene and similar monomers, acrylonitrile, N-vinylpyrrolidone, N-vinylformamide, N-vinylimidazole and N-vinylpyridine.

Further sulfone-containing copolymers suitable as component C are copolymers formed from i) unsaturated carboxylic acids ii) monomers containing sulfonic acid groups and iii) optionally further ionic or nonionic monomers.

In the context of the present invention, preferred monomers are unsaturated carboxylic acids i) of the formula (III), $$R^6(R^7)C{=}C(R^8)COOH \quad (III)$$

in which $R^6$ to $R^8$ are each independently hydrogen, methyl, a straight-chain or branched saturated alkyl radical having 2 to 12 carbon atoms, a straight-chain or branched, mono- or polyunsaturated alkenyl radical having 2 to 12 carbon atoms, —$NH_2$—, —OH— or —COOH-substituted alkyl or alkenyl radicals as defined above, or —COOH or —$COOR^9$, where $R^9$ is a saturated or unsaturated, straight-chain or branched hydrocarbon radical having 1 to 12 carbon atoms.

Among the unsaturated carboxylic acids which can be described by the formula (III), preference is given especially to acrylic acid ($R^6{=}R^7{=}R^8{=}H$), methacrylic acid ($R^6{=}R^7{=}H$, $R^8{=}CH_3$) and/or maleic acid ($R^6{=}COOH$, $R^7{=}R^8{=}H$).

In the case of the monomers containing sulfonic acid groups, preference is given to those of the formula (IV), $$R^{10}(R^{11})C{=}C(R^{12})—X—SO_3H \quad (IV)$$

in which $R^{10}$ to $R^{12}$ are each independently hydrogen, methyl, a straight-chain or branched, saturated alkyl radical having 2 to 12 carbon atoms, a straight-chain or branched, mono- or polyunsaturated alkenyl radical having 2 to 12 carbon atoms, —$NH_2$—, —OH— or —COOH-substituted alkyl or alkenyl radicals as defined above, or —COOH or —$COOR^9$, where $R^9$ is a saturated or unsaturated, straight-chain or branched hydrocarbon radical having 1 to 12 carbon atoms, and X is an optionally present spacer group which is selected from —$(CH_2)_n$— where n=0 to 4, —COO—$(CH_2)_k$— where k=1 to 6, —C(O)—NH—$C(CH_3)_2$— and —C(O)—NH—CN$(CH_2CH_3)$—.

Among these monomers, preference is given to those of the formulae IVa, IVb and/or IVc, $$H_2C{=}CH—X—SO_3H \quad (IVa)$$

$$H_2C{=}C(CH_3)—X—SO_3H \quad (IVb)$$

$$HO_3S—X—(R^{11})C{=}C(R^{12})—X—SO_3H \quad (IVc)$$

in which $R^{11}$ and $R^{12}$ are each independently selected from hydrogen, methyl, ethyl, propyl, isopropyl and X is an optionally present spacer group which is selected from —(CH2)n— where n=0 to 4, —COO—(CH2)k— where k=1 to 6, —C(O)—NH—$C(CH_3)_2$— and —C(O)—NH—CH$(CH_2CH_3)$—.

Particularly preferred monomers containing sulfonic acid groups are 1-acrylamido-1-propanesulfonic acid (X=—C(O)NH—CH$(CH_2CH_3)$ in formula IVa), 2-acrylamido-2-propanesulfonic acid (X=—C(O)NH—$C(CH_3)_2$ in formula IVa), 2-acrylamido-2-methyl-1-propanesulfonic acid (X=—C(O)NH—CH$(CH_3)CH_2$— in formula IVa), 2-methacrylamido-2-methyl-1-propanesulfonic acid (X=—C(O)NH—CH$(CH_3)CH_2$— in formula IVb), 3-methacrylamido-2-hydroxypropanesulfonic acid (X=—C(O)NH—$CH_2$CH(OH)$CH_2$— in formula IVb), allylsulfonic acid (X=$CH_2$ in formula IVa), methallylsulfonic acid (X=$CH_2$ in formula IIIb), allyloxybenzenesulfonic acid (X=—$CH_2$—O—$C_6H_4$— in formula IVa), methallyloxybenzenesulfonic acid (X=—$CH_2$—O—$C_6H_4$— in formula IVb), 2-hydroxy-3-(2-propenyloxy)propanesulfonic acid, 2-methyl-2-propene-1-sulfonic acid (X=$CH_2$ in formula IVb), styrenesulfonic acid (X=$C_6H_4$ in formula IVa), vinylsulfonic acid (X not present in formula IVa), 3-sulfopropyl acrylate (X=—C(O)NH—$CH_2CH_2CH_2$— in formula IVa), 3-sulfopropyl methacrylate (X=—C(O)NH—$CH_2CH_2CH_2$— in formula IVb), sulfomethacrylamide (X=—C(O)NH— in formula IVb), sulfomethylmethacrylamide (X=—C(O)NH—$CH_2$— in formula IVb) and water-soluble salts of the acids mentioned.

Further ionic or nonionic monomers include especially ethylenically unsaturated compounds. Preference is given to using a nonionic monomer of the formula V $$H_2C{=}C(R^{13})C({=}O)—O—R^{14}—[R^{15}—O]_o—R^{15} \quad (V)$$

in which $R^{13}$ is hydrogen or methyl, $R^{14}$ is a chemical bond or a straight-chain or branched $C_1$-$C_6$-alkyl radical, each $R^{15}$ represents identical or different, straight-chain or branched $C_1$-$C_6$-alkyl radicals, and o is a natural number from 3 to 50, incorporated by random or block copolymerization comprises.

The content in the aforementioned polymers containing sulfonic acid groups of monomers of group iii) is preferably less than 20% by weight, based on the polymer. Particularly preferred polymers containing sulfonic acid groups consist solely of monomers of groups i) and ii).

Any above-described copolymers present in the inventive dishwasher detergents may comprise the monomers from groups i) and ii) and optionally iii) in varying amounts, it being possible to combine all representatives from group i) with all representatives from group ii) and all representatives from group iii).

In the copolymers C, some or all of the sulfonic acid groups may be present in neutralized form, which means that the acidic hydrogen atom of the sulfonic acid group in some or all sulfonic acid groups may be exchanged for metal ions, preferably alkali metal ions, and especially for sodium ions. Corresponding inventive compositions wherein the sulfonic acid groups are present partly or fully neutralized in the copolymer are preferred in accordance with the invention.

The monomer distribution in the copolymers, in the case of copolymers which comprise only monomers from groups i) and ii), is preferably 5 to 95% by weight each of i) and ii), more preferably 50 to 90% by weight of monomer from group i) and 5 to 95% by weight, more preferably 10 to 50% by weight, of monomer from group ii), based in each case on the polymer.

In the case of terpolymers, particular preference is given to those which comprise 20 to 85% by weight of monomer from group i), 10 to 60% by weight of monomer from group ii) and 5 to 30% by weight of monomer from group iii).

The molar mass of the above-described copolymers present in the inventive dishwasher detergents can be varied in order to adjust the properties of the polymers to the desired end use. In preferred uses, the copolymers have molar masses of 2000 to 200 000 g/mol, preferably of 4000 to 25 000 g/mol and especially of 5000 to 15 000 g/mol.

In a preferred embodiment, in the inventive dishwasher detergent, it is possible to use, as component C, copolymers which comprise a) 30 to 95 mol % of acrylic acid and/or methacrylic acid and/or of a water-soluble salt of acrylic acid and/or of a water-soluble salt of methacrylic acid, b) 3 to 35 mol % of at least one monomer which contains sulfonic acid groups and is of the formula III, c) 2 to 35 mol % of at least one nonionic monomer of the formula V $$H_2C{=}C(R^{13})C({=}O)—O—R^{14}—[R^{15}—O]_o—R^{15} \quad (V)$$

in which $R^{13}$ is hydrogen or methyl, $R^{14}$ is a chemical bond or a straight-chain or branched $C_1$-$C_6$-alkyl radical, each $R^{15}$ represents identical or different, straight-chain or branched $C_1$-$C_6$-alkyl radicals, and o is a natural number from 3 to 50, incorporated by random or block copolymerization.

The proportion a) of copolymerized acrylic acid and/or methacrylic acid and/or of a water-soluble salt of these acids is preferably 50 to 90 mol %, preferably 55 to 85 mol % and more preferably 60 to 90 mol %. The proportion b) of copolymerized monomers which contain sulfonic acid groups and are of the formula (IV) is preferably 4 to 30 mol %, preferably 5 to 25 mol % and more preferably 5 to 20 mol %. The proportion c) of monomer units of the formula (V) is preferably 3 to 30 mol %, more preferably 4 to 25 mol % and especially 5 to 20 mol %. All aforementioned molar percentages are based on the polymer present in the inventive compositions.

The K value of the copolymers is preferably 15 to 35, especially 20 to 32, in particular 27 to 30 (measured in 1% by weight aqueous solution at 25° C.).

Component (D)

The phosphate-free machine dishwasher detergent comprises, as component D, 0 to 15% by weight, preferably 0.5 to 12% by weight, more preferably 1 to 10% by weight, of at least one hydrophilically modified polycarboxylate which inhibits the formation of deposits consisting of calcium phosphate.

In a preferred embodiment, the hydrophilically modified polycarboxylates used are copolymers which comprise alkylene oxide units and are formed from (1) 50 to 93 mol % of acrylic acid and/or of a water-soluble salt of acrylic acid, (2) 5 to 30 mol % of methacrylic acid and/or of a water-soluble salt of methacrylic acid and (3) 2 to 20 mol % of at least one nonionic monomer of the formula VI $$H_2C{=}C(R^{16})-C({=}O)-O-R^{17}-[-R^{18}-O-]_s-R^{19} \quad \text{(VI)},$$

in which the variables are each defined as follows:

$R^{16}$ is hydrogen or methyl;

$R^{17}$ is a chemical bond or unbranched or branched $C_1$-$C_6$-alkylene;

$R^{18}$ are identical or different unbranched or branched $C_2$-$C_4$-alkylene radicals;

$R^{19}$ is unbranched or branched $C_1$-$C_6$-alkyl;

s is 3 to 50, where components (1), (2) and (3) are incorporated by random or block copolymerization.

These copolymers comprising alkylene oxide units comprise, as copolymerized components (1) and (2), acrylic acid or methacrylic acid and/or water-soluble salts of these acids, especially the alkali metal salts such as potassium and in particular sodium salts, and ammonium salts.

The proportion of acrylic acid (1) in the copolymers for use in accordance with the invention is 50 to 93 mol %, preferably 65 to 85 mol % and more preferably 65 to 75 mol %.

Methacrylic acid (2) is present in the copolymers for use in accordance with the invention to an extent of 5 to 30 mol %, preferably to an extent of 10 to 25 mol % and in particular to an extent of 15 to 25 mol %.

The copolymers comprise, as component (3), nonionic monomers of the formula VI $$H_2C{=}C(R^{16})-C({=}O)-O-R^{17}-[-R^{18}-O-]_s-R^{19} \quad \text{(VI)}$$

where $R^{16}$ is hydrogen or preferably methyl;

$R^{17}$ is unbranched or branched $C_1$-$C_6$-alkylene or preferably a chemical bond;

$R^{18}$ are identical or different unbranched or branched $C_2$-$C_4$-alkylene radicals, in particular $C_2$-$C_3$-alkylene radicals, especially ethylene;

$R^{19}$ is unbranched or branched $C_1$-$C_6$-alkyl, preferably $C_1$-$C_2$-alkyl;

s is 3 to 50, preferably 5 to 40, more preferably 10 to 30.

Particularly suitable examples of the monomers of the formula (VI) include: methoxypolyethylene glycol (meth)acrylate, methoxypolypropylene glycol (meth)acrylate, methoxypolybutylene glycol (meth)acrylate, methoxypoly(propylene oxide-co-ethylene oxide) (meth)acrylate, ethoxypolyethylene glycol (meth)acrylate, ethoxypolypropylene glycol (meth)acrylate, ethoxypolybutylene glycol (meth)acrylate and ethoxypoly(propylene oxide-co-ethylene oxide) (meth) acrylate, preference being given to methoxypolyethylene glycol (meth)acrylate and methoxypolypropylene glycol (meth) acrylate and particular preference to methoxypolyethylene glycol methacrylate.

The polyalkylene glycols comprise 3 to 50, especially 5 to 40 and in particular 10 to 30 alkylene oxide units.

The proportion of the nonionic monomers (3) in the copolymers D for use in accordance with the invention is 2 to 20 mol %, preferably 5 to 15 mol % and in particular 5 to 10 mol %.

The copolymers D for use in accordance with the invention generally have a mean molecular weight $M_w$ from 3000 to 50 000 g/mol, preferably from 10 000 to 30 000 g/mol and more preferably from 15 000 to 25 000 g/mol.

The K value of the copolymers D is typically 15 to 40, especially 20 to 35, in particular 27 to 30 (measured in 1% by weight aqueous solution at 25 DEG C., according to H. Fikentscher, Cellulose-Chemie, Vol. 13, pp. 58-64 and 71-74 (1932)).

The copolymers C and D for use in accordance with the invention can be prepared by free-radical polymerization of the monomers. This can be done by any free-radical polymerization process known to those skilled in the art. In addition to polymerization in bulk, mention should be made especially of the processes of solution polymerization and of emulsion polymerization, preference being given to solution polymerization.

The polymerization is preferably performed in water as the solvent. It can, however, also be undertaken in alcoholic solvents, especially $C_1$-$C_4$-alcohols, such as methanol, ethanol and isopropanol, or mixtures of these solvents with water.

Suitable polymerization initiators include compounds which decompose either thermally or photochemically (photoinitiators), and form free radicals as they do so.

Among the thermally activatable polymerization initiators, preference is given to initiators with a decomposition temperature in the range from 20 to 180° C., especially from 50 to 90° C. Examples of suitable thermal initiators are inorganic peroxo compounds such as peroxodisulfates (ammonium and preferably sodium peroxodisulfate), peroxosulfates, percarbonates and hydrogen peroxide; organic peroxo compounds such as diacetyl peroxide, di-tert-butyl peroxide, diamyl peroxide, dioctanoyl peroxide, didecanoyl peroxide, dilauroyl peroxide, dibenzoyl peroxide, bis(o-toloyl) peroxide, succinyl peroxide, tert-butyl peracetate, tert-butyl permaleate, tert-butyl perisobutyrate, tert-butyl perpivalate, tert-butyl peroctoate, tert-butyl perneodecanoate, tert-butyl perbenzoate, tert-butyl peroxide, tert-butyl hydroperoxide, cumene hydroperoxide, tert-butyl peroxy-2-ethylhexanoate and diisopropyl peroxydicarbamate; azo compounds such as 2,2'-azobisisobutyronitrile, 2,2'-azobis(2-methylbutyronitrile) and azobis(2-amidopropane) dihydrochloride.

These initiators can be used in combination with reducing compounds as initiator/regulator systems. Examples of such reducing compounds include phosphorus compounds such as phosphorous acid, hypophosphites and phosphinates, sulfur compounds such as sodium hydrogen sulfite, sodium sulfite and sodium formaldehydesulfoxylate, and also hydrazine.

Examples of suitable photoinitiators are benzophenone, acetophenone, benzoin ethers, benzyl dialkyl ketones and derivatives thereof.

Preference is given to using thermal initiators, preferred thermal initiators being inorganic peroxo compounds, especially sodium peroxodisulfate (sodium persulfate). Particularly advantageously, the peroxo compounds are used in combination with sulfur-containing reducing agents, especially sodium hydrogen sulfite, as redox initiator system. In the case of use of this initiator/regulator system, copolymers which comprise $—SO_3^-Na^+$ and/or $—SO_4^-Na^+$ as end groups are obtained, which are notable for particular cleaning power and deposit-inhibiting action.

Alternatively, it is also possible to use phosphorus-containing initiator/regulator systems, e.g. hypophosphites/phosphinates.

The amounts of photoinitiator or initiator/regulator system should be adjusted to the substances used in each case. When, for example, the preferred peroxodisulfate/hydrogen sulfite system is used, typically 2 to 6% by weight, preferably 3 to 5% by weight, of peroxodisulfate and generally 5 to 30% by weight, preferably 5 to 10% by weight, of hydrogen sulfite are used, based in each case on the total amount of the monomers to be polymerized.

If desired, it is also possible to use polymerization regulators. Suitable compounds are those known to those skilled in the art, for example sulfur compounds such as mercaptoethanol, 2-ethylhexyl thioglycolate, thioglycolic acid and dodecyl mercaptan. When polymerization regulators are used, the amount thereof used is generally 0.1 to 15% by weight, preferably 0.1 to 5% by weight and more preferably 0.1 to 2.5% by weight, based on the total amount of the monomers to be polymerized.

The temperature in the preparation of the polymers which can be used in accordance with the invention is generally 30 to 200° C., preferably 50 to 150° C. and more preferably 80 to 120° C.

The polymerization can be performed under atmospheric pressure, but it is preferably undertaken in a closed system under the autogenous pressure which evolves.

In the preparation of the copolymers D for use in accordance with the invention, the monomers (1), (2) and (3) can be used as such, but it is also possible to use reaction mixtures obtained in the preparation of the monomers (3). For example, instead of methoxypolyethylene glycol methacrylate, it is possible to use the monomer mixture obtained in the esterification of polyethylene glycol monomethyl ether with an excess of methacrylic acid. The esterification can advantageously also be performed in situ in the polymerization mixture, by combining acrylic acid, a mixture of methacrylic acid and polyethylene glycol monomethyl ether and free-radical initiator in parallel. If appropriate, a catalyst needed for the esterification, such as methane sulfonic acid or p-toluene sulfonic acid, can be used additionally.

The copolymers D for use in accordance with the invention can also be prepared by polymer-analogous reaction, for example by reaction of an acrylic acid/methacrylic acid copolymer with polyalkylene glycol monoalkyl ether. Preference is given, however, to the free-radical copolymerization of the monomers.

If desired for the application, the aqueous solutions obtained in the preparation of the carboxyl-containing copolymers for use in accordance with the invention can be neutralized or partly neutralized, i.e. adjusted to a pH in the range of 4-8, preferably 4.5-7.5, by adding base, especially sodium hydroxide solution.

The copolymers C and D used in accordance with the invention are outstandingly suitable as an additive to machine dishwasher detergents. They are notable in particular for their deposit-inhibiting action both with respect to inorganic and organic deposits. Mention should be made especially of deposits caused by the remaining constituents of the detergent formulation, such as deposits of calcium phosphate and magnesium phosphate, calcium silicate and magnesium silicate, calcium phosphonate and magnesium phosphonate, calcium carbonate and magnesium carbonate, and deposits which originate from the soil constituents of the wash liquor, such as grease, protein and starch deposits.

The copolymers used in accordance with the invention also increase the cleaning power of the dishwasher detergent as a result. In addition, even in small concentrations, they promote the runoff of the water from the ware, such that the proportion of rinse surfactants in the dishwasher detergent can be reduced.

The copolymers C and D used in accordance with the invention can be used directly in the form of the aqueous solutions obtained in the course of preparation, or in dried form, for example obtained by spray drying, fluidized spray drying, roller drying or freeze drying.

Component (E)

As component E, 0 to 8% by weight, preferably 0 to 7% by weight, more preferably 0 to 6% by weight, of at least one polycarboxylate is present in the inventive dishwasher detergent. Suitable polycarboxylates are homo- and copolymers of acrylic acid or of methacrylic acid with monoethylenically unsaturated dicarboxylic acids such as maleic acid, fumaric acid, maleic anhydride, itaconic acid and citraconic acid. A suitable polymer is especially polyacrylic acid, which preferably has a molecular mass from 2000 to 20 000 g/mol. Owing to their superior solubility, from this group, the short-chain polyacrylic acid, which has molar masses from 2000 to 10 000 g/mol, especially 3000 to 5000 g/mol, may be preferred. Also suitable are copolymeric polycarboxylates, especially those of acrylic acid with methacrylic acid and of acrylic acid or methacrylic acid with maleic acid and/or fumaric acid. Particularly suitable copolymers have been found to be those of acrylic acid with maleic acid which comprise 30 to 90% by weight of acrylic acid and 70 to 10% by weight of maleic acid. The relative molecular mass thereof, based on free acids, is generally 1000 to 150 000 g/mol, preferably 1500 to 100 000 g/mol and especially 2500 to 80 000 g/mol. The polycarboxylate present in the inventive mixture prevents the formation of calcium carbonate deposits.

Component (F)

The inventive machine dishwasher detergent comprises, as component (F), 1 to 50% by weight, preferably 2 to 45% by weight, more preferably 5 to 40% by weight, of at least one complexing agent, preferably a chelate complexing agent.

Chelate complexing agents are substances which form cyclic compounds with metal ions, an individual ligand occupying more than one coordination site on a central atom, i.e. being at least "bidentate". In this case, normally extended compounds are thus closed to give rings by complex formation via an ion. The number of bound ligands depends on the coordination number of the central ion.

Chelate complexing agents which are commonly used and preferred in the context of the present invention are, for example, polyoxycarboxylic acids, polyamines, ethylenediaminetetraacetic acid (EDTA), nitrilotriacetic acid (NTA), methyleneglycinediacetic acid (MGDA) and glutaminediacetic acid (GLDA). It is also possible to use mixtures. Also usable in accordance with the invention are complex-forming polymers, i.e. polymers which bear functional groups either in the main chain itself or pendent to it, which can act as ligands and react with suitable metal atoms generally to form chelate complexes. The polymer-bound ligands of the resulting metal complexes can originate from just one macromolecule or else belong to different polymer chains. The latter leads to the crosslinking of the material when the complex-forming polymers have not already been crosslinked beforehand via covalent bonds.

Complexing groups (ligands) of customary complex-forming polymers are iminodiacetic acid, hydroxyquinoline, thiourea, guanidine, dithiocarbamate, hydroxamic acid, amidoxime, aminophosphoric acid, (cyclic) polyamino, mercapto, 1,3-dicarbonyl and crown ether radicals, some of which have very specific activities toward ions of different metals. Basis polymers of many complex-forming polymers, which are also commercially significant, are polystyrene, polyacrylates, polyacrylonitriles, polyvinyl alcohols, polyvinylpyridines and polyethylenimines. Natural polymers, such as cellulose, starch or chitin are also complex-forming polymers. In addition, they may be provided with further ligand functionalities as a result of polymer-analogous modifications.

In the context of the present invention, it is possible to use all prior art complexing agents. These may belong to different chemical groups. Preference is given to using the following, individually or in a mixture with one another:

i) polycarboxylic acids in which the sum of the carboxyl and any hydroxyl groups is at least 5, such as gluconic acid,
ii) nitrogen-containing mono- or polycarboxylic acids, such as ethylenediaminetetraacetic acid (EDTA), N-hydroxyethylethylenediaminetriacetic acid, diethylenetriaminepentaacetic acid, hydroxyethyliminodiacetic acid, nitridodiacetic acid-3-propionic acid, isoserinediacetic acid, N,N-di(β-hydroxyethyl)glycine, N-(1,2-dicarboxy-2-hydroxyethyl)glycine, N-(1,2-dicarboxy-2-hydroxyethyl)aspartic acid, nitrilotriacetic acid (NTA), methyleneglycinediacetic acid (MGDA) and glutaminediacetic acid (GLDA),
iii) geminal diphosphonic acids, such as 1-hydroxyethane-1,1-diphosphonic acid (HEDP), higher homologs thereof having up to 8 carbon atoms, and hydroxyl- or amino-containing derivatives thereof and 1-aminoethane-1,1-diphosphonic acid, higher homologs thereof having up to 8 carbon atoms, and hydroxyl- or amino-containing derivatives thereof,
iv) aminophosphonic acids, such as ethylenediaminetetra(methylenephosphonic acid), diethylenetriaminepenta(methylenephosphonic acid) or nitrilotri(methylenephosphonic acid),
v) phosphonopolycarboxylic acids, such as 2-phosphonobutane-1,2,4-tricarboxylic acid, and
vi) cyclodextrins.

At the alkaline pH values required in accordance with the invention for the treatment solutions, the complexing agents are present at least partly in the form of anions. It is unimportant whether they are introduced in the form of the acids or in the form of salts. In the case of use as salts, preference is given to alkali metal, ammonium or alkylammonium salts, especially sodium salts.

In a particularly preferred embodiment, component (F) used is a complexing agent selected from the group consisting of nitrilotriacetic acid (NTA), methyleneglycinediacetic acid (MGDA), glutaminediacetic acid (GLDA) and mixtures thereof.

Component (G)

The phosphate-free machine dishwasher detergent comprises, as component (G), 0.01 to 60% by weight, preferably 0.05 to 50% by weight, more preferably 0.1 to 40% by weight, of at least one further additive. Suitable additives are selected from the group consisting of builders, enzymes, bleaches, bleach activators, dyes and fragrances, corrosion inhibitors, stabilizers such as antioxidants or UV absorbers, fillers, further surfactants and polymers, extenders and tablet binders.

Builders

The inventive detergents for machine dishwashing comprise builders. They may comprise all builders used customarily in washing and cleaning compositions, especially silicates, carbonates, zeolites, and organic builders and cobuilders such as citrates or polycarboxylates.

Suitable crystalline, sheet-type sodium silicates have the general formula $NaMSi_xO_{2x+1}.y\ H_2O$, where M is sodium or hydrogen, x is from 1.9 to 4 and y is from 0 to 20, and preferred values for x are 2, 3 or 4. Preferred crystalline sheet silicates of the formula specified are those in which M is sodium and x assumes the values of 2 or 3. In particular, preference is given to both β- and also δ-sodium disilicates $Na_2Si_2O_5.yH_2O$.

It is also possible to use amorphous sodium silicates having an $Na_2O:SiO_2$ modulus of 1:2 to 1:3.3, preferably of 1:2 to 1:2.8 and in particular of 1:2 to 1:2.6, which have retarded dissolution and secondary washing properties. The retardation of dissolution relative to conventional amorphous sodium silicates may have been brought about in a variety of ways, for example by surface treatment, compounding, compacting or by overdrying. In the context of this invention, the term "amorphous" also includes "X-ray-amorphous". This means that, in X-ray diffraction experiments, the silicates do not afford any sharp X-ray reflections typical of crystalline substances, but rather yield at best one or more maxima of the scattered X-ray radiation, which have a width of several degree units of the diffraction angle. However, it may quite possibly even lead to particularly good builder properties if the silicate particles in electron diffraction experiments yield vague or even sharp diffraction maxima. This is to be interpreted such that the products have microcrystalline regions with a size of 10 to several hundred nm, preference being given to values up to a maximum of 50 nm and in particular up to a maximum of 20 nm. Special preference is given to compacted amorphous silicates, compounded amorphous silicates and overdried X-ray-amorphous silicates.

The optionally usable finely crystalline, synthetic, bound water-containing zeolite is preferably zeolite A and/or P. The zeolite P is more preferably Zeolite MAP® (commercial product from Crosfield). Also suitable, however, are zeolite X, and mixtures of A, X and/or P. Also commercially available and usable with preference in accordance with the present invention is, for example, a cocrystal of zeolite X and zeolite A (approx. 80% by weight of zeolite X), which is sold by CONDEA Augusta S.p.A. under the VEGOBOND AX® brand name and can be described by the formula (VII)

$$nNa_2O.(1-n)K_2O.Al_2O_3.(2-2.5)SiO_2.(3.5-5.5)H_2O \quad \text{(VII)}.$$

Suitable zeolites have an average particle size of less than 10 μm (volume distribution; measurement method: Coulter Counter) and preferably comprise 18 to 22% by weight, especially 20 to 22% by weight, of bound water.

The inventive compositions may further comprise carbonates and/or hydrogencarbonates as builders. Among these, the alkali metal salts, especially sodium carbonate, are particularly preferred.

The organic cobuilders that can be used in the inventive machine dishwasher detergents include especially polycarboxylates/polycarboxylic acids, polymeric polycarboxylates, aspartic acid, polyacetals, dextrins, further organic cobuilders (see below) and phosphonates. These substance classes are described below.

Organic builder substances which can be used are, for example, the polycarboxylic acids usable in the form of their sodium salts, polycarboxylic acids referring to those carboxylic acids which bear more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), as long as such a use is not objectionable on ecological grounds, and mixtures thereof. Preferred salts are the salts of the polycarboxylic acids such as citric acid, adipic acid, succinic acid, glutaric acid, tartaric acid, sugar acids and mixtures thereof.

The acids themselves may also be used. In addition to their builder action, the acids typically also have the property of an acidifying component and thus also serve to set a lower and milder pH of washing and cleaning compositions. In this connection, particular mention should be made of citric acid, succinic acid, glutaric acid, adipic acid, gluconic acid and any mixtures thereof.

Further preferred builder substances which should likewise be mentioned are polymeric aminodicarboxylic acids, salts thereof or precursor substances thereof. Particular preference is given to polyaspartic acids, or salts and derivatives thereof which, as well as cobuilder properties, also have a bleach-stabilizing action.

Further suitable builder substances are polyacetals which can be obtained by reacting dialdehydes with polyolcarboxylic acids which have 5 to 7 carbon atoms and at least 3 hydroxyl groups. Preferred polyacetals are obtained from dialdehydes such as glyoxal, glutaraldehyde, terephthalaldehyde, and mixtures thereof, and from polyolcarboxylic acids such as gluconic acid and/or glucoheptonic acid.

Further suitable organic builder substances are dextrins, for example oligomers or polymers of carbohydrates, which can be obtained by partial hydrolysis of starches. The hydrolysis can be carried out by customary, for example acid-catalyzed or enzyme-catalyzed, processes. The hydrolysis products preferably have average molar masses in the range from 400 to 500 000 g/mol. Preference is given to a polysaccharide having a dextrose equivalent (DE) in the range from 0.5 to 40, in particular from 2 to 30, where DE is a common measure of the reducing action of a polysaccharide compared to dextrose, which has a DE of 100. It is also possible to use maltodextrins with a DE between 3 and 20 and dry glucose syrups with a DE between 20 and 37, and also what are known as yellow dextrins and white dextrins having molar masses in the range from 2000 to 30 000 g/mol.

The oxidized derivatives of such dextrins are their reaction products with oxidizing agents which are capable of oxidizing at least one alcohol function of the saccharide ring to the carboxylic acid function. A product oxidized at C6 of the saccharide ring may be particularly advantageous.

Oxydisuccinates and other derivatives of disuccinates, preferably ethylenediaminedisuccinate, are also further suitable cobuilders. In this case, ethylenediamine-N,N'-disuccinate (EDDS) is preferably used in the form of its sodium or magnesium salts. Furthermore, in this connection, preference is also given to glyceryl disuccinates and glyceryl trisuccinates.

Further organic cobuilders which can be used are, for example, acetylated hydroxycarboxylic acids or salts thereof, which may also be present in lactone form and which comprise at least 4 carbon atoms and at least one hydroxyl group and a maximum of two acid groups.

A further class of substances having cobuilder properties is that of the phosphonates. These are in particular hydroxyalkane- and aminoalkanephosphonates. Among the hydroxyalkanephosphonates, 1-hydroxyethane-1,1-diphosphonate (HEDP) is of particular significance as a cobuilder. It is preferably used in the form of the sodium salt, the disodium salt giving a neutral reaction and the tetrasodium salt an alkaline reaction (pH 9). Useful aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, for example as the hexasodium salt of EDTMP or as the hepta- and octasodium salt of DTPMP. From the class of the phosphonates, preference is given to using HEDP as a builder. In addition, the aminoalkanephosphonates have a marked heavy metal-binding capacity. Accordingly, especially when the compositions also comprise bleaches, it may be preferable to use aminoalkanephosphonates, especially DTPMP, or mixtures of the phosphonates mentioned.

In addition, it is possible to use all compounds which are capable of forming complexes with alkaline earth metal ions as cobuilders.

Enzymes

To enhance the washing or cleaning performance, inventive compositions may comprise enzymes, it being possible in principle to use all enzymes established for these purposes in the prior art. These include in particular enzymes selected from the group consisting of proteases, amylases, lipases, hemicellulases, cellulases or oxidoreductases, and preferably mixtures thereof. These enzymes are in principle of natural origin. Starting from the natural molecules, improved variants are available for use in washing and cleaning compositions and are preferably used accordingly. Inventive compositions preferably comprise enzymes in total amounts of 1 $10^{-6}$ to 5% by weight based on active protein. The protein concentration may be determined with the aid of known methods, for example the BCA method or the biuret method.

Among the proteases, preference is given to those of the subtilisin type. Examples thereof include the subtilisins BPN' and Carlsberg, protease PB92, the subtilisins 147 and 309, *Bacillus lentus* alkaline protease, subtilisin DY and the enzymes thermitase and proteinase K which can be classified among the subtilases but not among the subtilisins in the narrower sense, and the proteases TW3 and TW7. The subtilisin Carlsberg is available in a developed form under the trade name Alcalase® from Novozymes A/S, Bagsværd, Denmark. The subtilisins 147 and 309 are sold under the trade names Esperase® and Savinase® respectively by Novozymes. The variants listed under the name BLAP® are derived from the protease of *Bacillus lentus* DSM 5483.

Further examples of usable proteases are the enzymes available under the trade names Durazym®, Relase®, Everlase®, Nafizym, Natalase®, Kannase® and Ovozymes® from Novozymes, those under the trade names Purafect®, Purafect®OxP and Properase® from Genencor, that under the trade name Protosol® from Advanced Biochemicals Ltd., Thane, India, that under the trade name Wuxi® from Wuxi Snyder Bioproducts Ltd., China, those under the trade names Proleather® and Protease P® from Amano Pharmaceuticals Ltd., Nagoya, Japan and that under the name Proteinase K-16 from Kao Corp., Tokyo, Japan.

Examples of amylases which can be used in accordance with the invention are the amylases from *Bacillus licheniformis*, from *B. amyloliquefaciens* or from *B. stearothermophilus* and developments thereof which have been improved for use in washing and cleaning compositions. The *B. licheniformis* enzyme is available from Novozymes under the name Termamyl® and from Genencor under the name Purastar®ST. Development products of this amylase are obtainable from Novozymes under the trade names Duramyl® and Termamyl®ultra, from Genencor under the name Purastar®OxAm and from Daiwa Seiko Inc., Tokyo, Japan as Keistase®. The *B. amyloliquefaciens* α-amylase is sold by Novozymes under the name BAN®, and variants derived from the *B. stearothermophilus* amylase under the names BSG® and Novamyl®, likewise from Novozymes.

Enzymes which should additionally be emphasized for this purpose are the α-amylase from *Bacillus* sp. A 7-7 (DSM 12368), and the cyclodextrin glucanotransferase (CGTase) from *B. agaradherens* (DSM 9948). Also suitable are the developments of the amylase from *Aspergillus niger* and *A. oryzae*, which are available under the trade names Fungamyl® from Novozymes. Another commercial product is Amylase-LT®, for example.

Inventive compositions may comprise lipases or cutinases, especially owing to their triglyceride-cleaving activities, but also in order to generate peracids in situ from suitable precursors. Examples thereof include the lipases which were originally obtainable from *Humicola lanuginosa* (*Thermomyces lanuginosus*) or have been developed, in particular those with the D96L amino acid substitution. They are sold, for example, under the trade names Lipolase®, Lipolase®Ultra, LipoPrime®, Lipozyme® and Lipex® by Novozymes. It is additionally possible, for example, to use the cutinases which have originally been isolated from *Fusarium solani pisi* and *Humicola insolens*. Lipases which are also useful can be obtained under the designations Lipase CE®, Lipase P®, Lipase B®, Lipase CES®, Lipase AKG®, *Bacillis* sp. Lipase®, Lipase AP®, Lipase M-AP® and Lipase AML® from Amano. Examples of lipases and cutinases from Genencor which can be used are those whose starting enzymes have originally been isolated from *Pseudomonas mendocina* and *Fusarium solanii*. Other important commercial products include the M1 Lipase® and Lipomax® preparations originally sold by Gist-Brocades and the enzymes sold under the names Lipase MY-30®, Lipase OF® and Lipase PL® by Meito Sangyo KK, Japan, and also the Lumafast® product from Genencor.

Inventive compositions may comprise further enzymes which are embraced by the term "hemicellulases". These include, for example, mannanases, xanthane lyases, pectin lyases (=pectinases), pectin esterases, pectate lyases, xyloglucanases (=xylanases), pullulanases and β-glucanases. Suitable mannanases are available, for example, under the names Gamanase® and Pektinex AR® from Novozymes, under the name Rohapec® B1L from AB Enzymes and under the name Pyrolase® from Diversa Corp., San Diego, Calif., USA. The β-glucanase obtained from *B. subtilis* is available under the name Cereflo® from Novozymes.

To enhance the bleaching action, it is possible for inventive dishwasher detergents to comprise oxidoreductases, for example oxidases, oxygenases, catalases, peroxidases, such as haloperoxidases, chloroperoxidases, bromoperoxidases, lignin peroxidases, glucose peroxidases or manganese peroxidases, dioxygenases or laccases (phenol oxidases, polyphenol oxidases). Suitable commercial products include Denilite® 1 and 2 from Novozymes. Advantageously, preferably organic, more preferably aromatic, compounds which interact with the enzymes are additionally added in order to enhance the activity of the oxidoreductases concerned (enhancers), or to ensure the electron flux in the event of large differences in the redox potentials of the oxidizing enzymes and the soilings (mediators).

The enzymes used in inventive compositions derive either originally from microorganisms, for example of the genera *Bacillus, Streptomyces, Humicola*, or *Pseudomonas*, and/or are produced in biotechnology processes known per se by suitable microorganisms, for instance by transgenic expression hosts of the genera *Bacillus* or filamentous fungi.

The enzymes in question are preferably purified via processes which are established per se, for example via precipitation, sedimentation, concentration, filtration of the liquid phases, microfiltration, ultrafiltration, the action of chemicals, deodorization or suitable combinations of these steps.

The enzymes can be added to inventive compositions in any form established in the prior art. These include, for example, the solid preparations obtained by granulation, extrusion or lyophilization, or, especially in the case of liquid or gel-form compositions, solutions of the enzymes, advantageously highly concentrated, low in water and/or admixed with stabilizers. Alternatively, the enzymes may be encapsulated either for the solid or for the liquid administration form, for example by spray-drying or extrusion of the enzyme solution together with a preferably natural polymer, or in the form of capsules, for example those in which the enzymes are enclosed as in a solidified gel, or in those of the core-shell type, in which an enzyme-containing core is coated with a water-, air- and/or chemical-impermeable protective layer. It is possible in layers applied thereto to additionally apply further active ingredients, for example stabilizers, emulsifiers, pigments, bleaches or dyes. Such capsules are applied by methods known per se, for example by agitated or roll granulation or in fluidized bed processes. Advantageously, such granules, for example as a result of application of polymeric film formers, are low-dusting and storage-stable owing to the coating.

It is also possible to formulate two or more enzymes together, so that a single granule has a plurality of enzyme activities. A protein and/or enzyme present in an inventive composition may be protected, particularly during storage, from damage, for example inactivation, denaturation or decay, for instance by physical influences, oxidation or proteolytic cleavage. When the proteins and/or enzymes are obtained microbially, particular preference is given to inhibiting proteolysis, especially when the compositions also comprise proteases. For this purpose, inventive compositions may comprise stabilizers; the provision of such compositions constitutes a preferred embodiment of the present invention.

Bleaches

Among the compounds which serve as bleaches and supply $H_2O_2$ in water, sodium perborate tetrahydrate and sodium perborate monohydrate are of particular significance. Further bleaches which can be used are, for example, sodium percarbonate, peroxypyrophosphates, citrate perhydrates, and $H_2O_2$-supplying peracidic salts or peracids, such as perbenzoates, peroxophthalates, diperazelaic acid, phthaloimino peracid or diperdodecanedioic acid. Inventive detergents may also comprise bleaches from the group of the organic bleaches. Typical organic bleaches are the diacyl peroxides, for example dibenzoyl peroxide. Further typical organic bleaches are the peroxy acids, particular examples being the alkyl peroxy acids and the aryl peroxy acids. Preferred representatives are (a) the peroxybenzoic acid and ring-substituted derivatives thereof, such as alkylperoxybenzoic acids, but it is also possible to use peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid and N,N-terephthaloyldi(6-aminopercaproic acid).

The bleaches used in the inventive detergents for machine dishwashing may also be substances which release chlorine or bromine. Among suitable chlorine- or bromine-releasing materials, useful examples include heterocyclic N-bromoamides and N-chloroamides, for example trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

Bleach Activators

Bleach activators which promote the action of the bleaches may likewise be present in the inventive compositions. Known bleach activators are compounds which comprise one or more N- or O-acyl groups, such as substances from the class of the anhydrides, the esters, the imides and the acylated imidazoles or oximes. Examples are tetraacetylethylenediamine TAED, tetraacetylmethylenediamine TAMD and tetraacetylhexylenediamine TAHD, but also pentaacetylglucose PAG, 1,5-diacetyl-2,2-dioxohexahydro-1,3,5-triazine DADHT and isatoic anhydride ISA.

The bleach activators used may also be compounds which, under perhydrolysis conditions, give rise to aliphatic peroxocarboxylic acids having preferably 1 to 10 carbon atoms, in particular 2 to 4 carbon atoms, and/or optionally substituted perbenzoic acid. Suitable substances bear O-acyl and/or N-acyl groups of the number of carbon atoms specified, and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran, n-methyl-morpholiniumacetonitrile methylsulfate (MMA), and enol esters, and also acetylated sorbitol and mannitol or mixtures thereof (SORMAN), acylated sugar derivatives, in particular pentaacetylglucose (PAG), pentaacetylfructose, tetraacetylxylose and octaacetyllactose, and acetylated, optionally N-alkylated, glucamine and gluconolactone, and/or N-acylated lactams, for example N-benzoylcaprolactam. Hydrophilically substituted acylacetals and acyllactams are likewise used with preference. Combinations of conventional bleach activators can also be used.

In addition to the conventional bleach activators, or instead of them, it is also possible to incorporate so-called bleach catalysts into the rinse aid particles. These substances are bleach-boosting transition metal salts or transition metal complexes, for example salen or carbonyl complexes of manganese, iron, cobalt, ruthenium or molybdenum. It is also possible to use complexes of manganese, iron, cobalt, ruthenium, molybdenum, titanium, vanadium and copper with nitrogen-containing tripod ligands, and also cobalt-, iron-, copper- and ruthenium-ammine complexes as bleach catalysts.

Preference is given to using bleach activators from the group of the polyacylated alkylenediamines, especially tetraacetylethylenediamine (TAED), N-acylimides, especially N-nonanoylsuccinimide (NOSI), acylated phenolsulfonates, especially n-nonanoyl- or isononanoyloxybenzenesulfonate (n- or iso-NOBS), N-methylmorpholinioacetonitrile methylsulfate (MMA).

Dyes and Fragrances

Dyes and fragrances can be added to the inventive machine dishwasher detergents in order to improve the esthetic impression of the resulting products and to provide to the consumer, in addition to the performance, a visually and sensorily "typical and unmistakable" product. The perfume oils and/or fragrances used may be individual odorant compounds, for example the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methyl phenylglycinate, allyl cyclohexylpropionate, styrallyl propionate and benzyl salicylate. The ethers include, for example, benzyl ethyl ether; the aldehydes include, for example, the linear alkanals having 8-18 carbon atoms, citral, citronellal, citronellyloxyacetaldehyde, cyclamen aldehyde, hydroxycitronellal, lilial and bourgeonal; the ketones include, for example, the ionones, isomethylionone and methyl cedryl ketone; the alcohols include anethole, citronellol, eugenol, geraniol, linalool, phenylethyl alcohol and terpineol; the hydrocarbons include primarily the terpenes such as limonene and pinene. However, preference is given to using mixtures of different odorants which together produce a pleasing fragrance note. Such perfume oils may also comprise natural odorant mixtures, as are obtainable from vegetable sources, for example pine oil, citrus oil, jasmine oil, patchouli oil, rose oil or ylang-ylang oil. Likewise suitable are muscatel, sage oil, camomile oil, clove oil, balm oil, mint oil, cinnamon leaf oil, lime blossom oil, juniper berry oil, vetiver oil, olibanum oil, galbanum oil and labdanum oil, and also orange blossom oil, neroli oil, orange peel oil and sandalwood oil.

The fragrances can be incorporated directly into the inventive detergents, but it may also be advantageous to apply the fragrances to carriers which ensure long-lasting fragrance by slower fragrance release. Useful such carrier materials have been found to be, for example, cyclodextrins, and the cyclodextrin-perfume complexes may additionally also be coated with further assistants.

In order to improve the esthetic impression of the inventive compositions, it (or parts thereof) may be colored with suitable dyes. Preferred dyes have high storage stability and insensitivity toward the other ingredients of the compositions and to light, and also have no pronounced substantivity toward the substrates to be treated with the compositions, such as glass, ceramic or plastic dishware, so as not to stain them.

Corrosion Inhibitors

To protect the ware or the machine, the inventive detergents may comprise corrosion inhibitors, and particularly silver anticorrosives have special significance in the field of machine dishwashing. It is possible to use the known substances from the prior art. In general, it is possible in particular to use silver anticorrosives selected from the group of the triazoles, the benzotriazoles, the bisbenzotriazoles, the aminotriazoles, the alkylaminotriazoles and the transition metal salts or complexes. Particular preference is given to using benzotriazole and/or alkylaminotriazole. Frequently also found in detergent formulations are active chlorine-containing agents which can significantly reduce the corrosion of the silver surface. In chlorine-free cleaners, particularly oxygen- and nitrogen-containing organic redox-active compounds are used, such as di- and trihydric phenols, for example hydroquinone, pyrocatechol, hydroxyhydroquinone, gallic acid, phloroglucinol, pyrogallol and derivatives of these classes of compound. Salt- and complex-type inorganic compounds, such as salts of the metals manganese, titanium, zirconium, hafnium, vanadium, cobalt and cerium, also frequently find use. Preference is given in this context to the transition metal salts which are selected from the group of manganese and/or cobalt salts and/or complexes, more preferably cobalt(-ammine) complexes, cobalt(-acetate) complexes, cobalt(-carbonyl) complexes, the chlorides of cobalt or manganese, and manganese sulfate. Zinc compounds may likewise be used to prevent corrosion on the ware.

Preferred agents which are capable of providing corrosion protection for glassware in the course of machine dishwasher cleaning and/or rinsing operations originate from the group of the compounds of zinc, aluminum, silicon, tin, magnesium, calcium, strontium, titanium, zirconium, manganese and/or lanthanum. Among the compounds mentioned, especially the oxides are particularly preferred.

A preferred agent for providing corrosion protection for glassware in cleaning and/or rinsing operations of a machine dishwasher is zinc in oxidized form, i.e. zinc compounds in which zinc is present in cationic form. Preference is also given analogously to magnesium salts. It is possible here for either soluble, or sparingly soluble or insoluble zinc or magnesium compounds to be incorporated into the inventive compositions. Preferred inventive compositions comprise one or more magnesium and/or zinc salt(s) of at least one monomeric and/or polymeric organic acid. The acids in question originate preferably from the group of the unbranched saturated or unsaturated monocarboxylic acids, the branched saturated or unsaturated monocarboxylic acids, the saturated and unsaturated dicarboxylic acids, the aromatic mono-, di- and tricarboxylic acids, the sugar acids, the hydroxy acids, the oxo acids, the amino acids and/or the polymeric carboxylic acids, the unbranched or branched, unsaturated or saturated, mono- or polyhydroxylated fatty acids having at least 8 carbon atoms and/or resin acids.

Even though all magnesium and/or zinc salts of monomeric and/or polymeric organic acids may be present in the polymer matrix in accordance with the invention, preference is given, as described above, to the magnesium and/or zinc salts of monomeric and/or polymeric organic acids from the groups of the unbranched, saturated or unsaturated monocarboxylic acids, the branched, saturated or unsaturated monocarboxylic acids, the saturated and unsaturated dicarboxylic acids, the aromatic mono-, di- and tricarboxylic acids, the sugar acids, the hydroxy acids, the oxo acids, the amino acids and/or the polymeric carboxylic acids. In the context of the present invention, preference is in turn given within these groups to the acids specified below:

From the group of the unbranched, saturated or unsaturated monocarboxylic acids: methanoic acid (formic acid), ethanoic acid (acetic acid), propanoic acid (propionic acid), pentanoic acid (valeric acid), hexanoic acid (caproic acid), heptanoic acid (enanthic acid), octanoic acid (caprylic acid), nonanoic acid (pelargonic acid), decanoic acid (capric acid), undecanoic acid, dodecanoic acid (lauric acid), tridecanoic acid, tetradecanoic acid (myristic acid), pentadecanoic acid, hexadecanoic acid (palmitic acid), heptadecanoic acid (margaric acid), octadecanoic acid (stearic acid), eicosanoic acid (arachic acid), docosanoic acid (behenic acid), tetracosanoic acid (lignoceric acid), hexacosanoic acid (cerotic acid), triacotanoic acid (melissic acid), 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12c,15c-octadecatrienoic acid (linolenic acid).

From the group of the branched, saturated or unsaturated monocarboxylic acids: 2-methylpentanoic acid, 2-ethylhexanoic acid, 2-propylheptanoic acid, 2-butyloctanoic acid, 2-pentylnonanoic acid, 2-hexyldecanoic acid, 2-heptylundecanoic acid, 2-octyldodecanoic acid, 2-nonyltridecanoic acid, 2-decyltetradecanoic acid, 2-undecylpentadecanoic acid, 2-dodecylhexadecanoic acid, 2-tridecylheptadecanoic acid, 2-tetradecyloctadecanoic acid, 2-pentadecylnonadecanoic acid, 2-hexadecyleicosanoic acid, 2-heptadecylheneicosanoic acid comprises.

From the group of the unbranched, saturated or unsaturated di- or tricarboxylic acids: propanedioic acid (malonic acid), butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), 2c-butenedioic acid (maleic acid), 2t-butenedioic acid (fumaric acid), 2-butynedicarboxylic acid (acetylenedicarboxylic acid).

From the group of the aromatic mono-, di- and tricarboxylic acids: benzoic acid, 2-carboxybenzoic acid (phthalic acid), 3-carboxybenzoic acid (isophthalic acid), 4-carboxybenzoic acid (terephthalic acid), 3,4-dicarboxybenzoic acid (trimellitic acid), 3,5-dicarboxybenzoic acid (trimesionic acid).

From the group of the sugar acids: galactonic acid, mannonic acid, fructonic acid, arabinonic acid, xylonic acid, ribonic acid, 2-deoxyribonic acid, alginic acid.

From the group of the hydroxy acids: hydroxyphenylacetic acid (mandelic acid), 2-hydroxypropionic acid (lactic acid), hydroxysuccinic acid (malic acid), 2,3-dihydroxybutanedioic acid (tartaric acid), 2-hydroxy-1,2,3-propanetricarboxylic acid (citric acid), ascorbic acid, 2-hydroxybenzoic acid (salicylic acid), 3,4,5-trihydroxybenzoic acid (gallic acid).

From the group of the oxo acids: 2-oxopropionic acid (pyruvic acid), 4-oxopentanoic acid (levulinic acid).

From the group of the amino acids: alanine, valine, leucine, isoleucine, proline, tryptophan, phenylalanine, methionine, glycine, serine, tyrosine, threonine, cysteine, asparagine, glutamine, aspartic acid, glutamic acid, lysine, arginine, histidine.

From the group of the polymeric carboxylic acids: polyacrylic acid, polymethacrylic acid, alkylacrylamide/acrylic acid copolymers, alkylacrylamide/methacrylic acid copolymers, alkylacrylamide/methylmethacrylic acid copolymers, copolymers of unsaturated carboxylic acids, vinyl acetate/crotonic acid copolymers, vinylpyrrolidone/vinyl acrylate copolymers.

The spectrum of the zinc salts, preferred in accordance with the invention, of organic acids, preferably of organic carboxylic acids, ranges from salts which are sparingly soluble or insoluble in water, i.e. have a solubility below 100 mg/l, preferably below 10 mg/l, in particular have zero solubility, to those salts which have a solubility in water above 100 mg/l, preferably above 500 mg/l, more preferably above 1 g/l and in particular above 5 g/l (all solubilities at water temperature 20° C.). The first group of zinc salts includes, for example, zinc citrate, zinc oleate and zinc stearate; the group of soluble zinc salts includes, for example, zinc formate, zinc acetate, zinc lactate and zinc gluconate.

In a further preferred embodiment of the present invention, the compositions according to the invention comprise at least one zinc salt, but no magnesium salt of an organic acid, preferably at least one zinc salt of an organic carboxylic acid, more preferably a zinc salt from the group of zinc stearate, zinc oleate, zinc gluconate, zinc acetate, zinc lactate and/or zinc citrate. Preference is also given to using zinc ricinoleate, zinc abietate and zinc oxalate. In summary, preferred machine dishwasher detergents additionally comprise one or more magnesium and/or zinc salts and/or magnesium and/or zinc complexes, preferably one or more magnesium and/or zinc salts of at least one monomeric and/or polymeric organic acid.

The inventive detergents for machine dishwashing may be provided in all supply forms known from the prior art, for example as pulverulent or granular detergents, as extrudates, pellets, flakes or tablets, preferably as tablets.

A further means of providing preportioned compositions is that of packaging in water-soluble receptacles. The inventive compositions can be packaged in water-soluble packages, for example film pouches, thermoformed parts, injection-molded parts, bottle-blown parts, etc. Preferred inventive machine dishwasher detergents are packaged in portions in a water-soluble envelope, the envelope preferably comprising one or more materials from the group of acrylic acid-containing polymers, polyacrylamides, oxazoline polymers, polystyrene sulfonates, polyurethanes, polyesters and polyethers and mixtures thereof, and preferably having a wall strength of 10 to 5000 μm, preferably of 20 to 3000 μm, more preferably of 25 to 2000 μm and especially of 100 to 1500 μm.

In particularly preferred machine dishwasher detergents, the water-soluble envelope comprises a pouch of water-soluble film and/or an injection-molded part and/or a blow-molded part and/or a thermoformed part, the envelope preferably comprising one or more water-soluble polymer(s), preferably a material from the group of (optionally acetalized) polyvinyl alcohol (PVAL), polyvinylpyrrolidone, polyethylene oxide, gelatine, cellulose, and derivatives thereof and mixtures thereof, more preferably (optionally acetalized) polyvinyl alcohol (PVAL).

The aforementioned polyvinyl alcohols are commercially widely available, for example under the Mowiol brand name (Clariant).

In the context of the present invention, preference is also given to inventive compositions whose package consists of at least partly water-soluble film composed of at least one polymer from the group of starch and starch derivatives, cellulose and cellulose derivatives, especially methyl cellulose and mixtures thereof.

Inventive portioned detergents, preferably those which are packaged in transparent pouches, may comprise a stabilizer as a further constituent. Stabilizers in the context of the invention are materials which protect the detergent constituents in their water-soluble transparent pouches from decomposition or deactivation by incident light. Particularly suitable stabilizers here have been found to be antioxidants, UV absorbers and fluorescent dyes.

Particularly suitable stabilizers in the context of the invention are the antioxidants. In order to prevent undesired changes to the formulations caused by incident light and hence free-radical decomposition, the formulations may comprise antioxidants.

The antioxidants used may be, for example, phenols, bisphenols and thiobisphenols substituted by sterically hindered groups. Further examples are propyl gallate, butylhydroxytoluene (BHT), butylhydroxyanisole (BHA), t-butylhydroquinone (TBHQ), tocopherol and the long-chain ($C_8$-$C_{22}$) esters of gallic acid, such as dodecyl gallate. Other substance classes are aromatic amines, preferably secondary aromatic amines and substituted p-phenylenediamines, phosphorus compounds with trivalent phosphorus, such as phosphines, phosphites and phosphonites, citric acids and citric acid derivatives such as isopropyl citrate, compounds comprising enediol groups, known as reductones, such as ascorbic acid and derivatives thereof such as ascorbyl palmitate, organosulfur compounds such as the esters of 3,3"-thiodipropionic acid with $C_{1-8}$-alkanols, especially $C_{10-18}$-alkanols, metal ion deactivators which are capable of complexing the autoxidation-catalyzing metal ions, for example copper, such as nitrilotriacetic acid, and derivatives and mixtures thereof.

A further class of stabilizers which can be used with preference is that of the UV absorbers. UV absorbers can improve the photostability of the formulation constituents. They include organic substances (light protection filters) which are capable of absorbing ultraviolet rays and emitting the energy absorbed again in the form of longer-wavelength radiation, for example heat. Compounds which have these desired properties are, for example, the compounds and derivatives of benzophenone having substituents in the 2 and/or 4 position which are effective by virtue of radiationless deactivation. Also suitable are substituted benzotriazoles, for example the water-soluble monosodium 3-(2N-benzotriazol-2-yl)-4-hydroxy-5-(methylpropyl)benzenesulfonate (Cibafast® H), 3-phenyl-substituted acrylates (cinnamic acid derivatives), optionally having cyano groups in the 2 position, salicylates, organic nickel complexes and natural substances such as umbelliferone and endogenous urocanic acid. Of particular significance are biphenyl and in particular stilbene derivatives which are available commercially as Tinosorb® FD or Tinosorb® FR ex Ciba. UV-B absorbers include 3-benzylidenecamphor or 3-benzylidenenorcamphor and derivatives thereof, for example 3-(4-methylbenzylidene)camphor; 4-aminobenzoic acid derivatives, preferably 2-ethylhexyl 4-(dimethylamino)benzoate, 2-octyl 4-(dimethylamino)benzoate and amyl 4-(dimethylamino)benzoate; esters of cinnamic acid, preferably 2-ethylhexyl 4-methoxycinnamate, propyl 4-methoxycinnamate, isoamyl 4-methoxycinnamate, 2-ethylhexyl 2-cyano-3,3-phenylcinnamate (octocrylene); esters of salicylic acid, preferably 2-ethylhexyl salicylate, 4-isopropylbenzyl salicylate, homomenthyl salicylate; derivatives of benzophenone, preferably 2-hydroxy-4-methoxybenzophenone, 2-hydroxy-4-methoxy-4'-methylbenzophenone, 2,2'-dihydroxy-4-methoxybenzophenone; esters of benzalmalonic acid, preferably di-2-ethylhexyl 4-methoxybenzomalonate; triazine derivatives, for example 2,4,6-trianilino(p-carbo-2'-ethyl-1'-hexyloxy)-1,3,5-triazine and octyltriazone or dioctylbutamidotriazone (Uvasorb® HEB); propane-1,3-diones, for example 1-(4-tert-butylphenyl)-3-(4'-methoxyphenyl)propane-1,3-dione; ketotricyclo(5.2.1.0)

decane derivatives. Also suitable are 2-phenylbenzimidazole-5-sulfonic acid and the alkali metal, alkaline earth metal, ammonium, alkylammonium, alkanolammonium and glucammonium salts thereof; sulfonic acid derivatives of benzophenones, preferably 2-hydroxy-4-methoxybenzophenone-5-sulfonic acid and its salts; sulfonic acid derivatives of 3-benzylidenecamphor, for example 4-(2-oxo-3-bornylidenemethyl)benzenesulfonic acid and 2-methyl-5-(2-oxo-3-bornylidene)sulfonic acid and salts thereof.

Useful typical UV-A filters are in particular derivatives of benzoylmethane, for example 1-(4'-tert-butylphenyl)-3-(4'-methoxyphenyl)propane-1,3-dione, 4-tert-butyl-4'-methoxydibenzoylmethane (Parsol 1789), 1-phenyl-3-(4'-isopropylphenyl)propane-1,3-dione, and enamine compounds. The UV-A and UV-B filters can of course also be used in mixtures. In addition to the soluble substances mentioned, insoluble light protection pigments are also suitable for this purpose, specifically finely dispersed, preferably nanoized, metal oxides or salts. Examples of suitable metal oxides are in particular zinc oxide and titanium dioxide and additionally oxides of iron, zirconium, silicon, manganese, aluminum and cerium, and mixtures thereof. The salts used may be silicates (talc), barium sulfate or zinc stearate. The particles should have an average diameter of less than 100 nm, preferably between 5 and 50 nm and in particular between 15 and 30 nm. They may have a spherical shape, although it is also possible to use particles which have an ellipsoidal shape or a shape which deviates in some other way from the spherical form. The pigments may also be surface-treated, i.e. hydrophilicized or hydrophobicized. Typical examples are coated titanium dioxides, for example titanium dioxide T 805 (Degussa) or Eusolex® T2000 (Merck). Suitable hydrophobic coating compositions are in particular silicones and especially trialkoxyoctylsilanes or simethicones. Preference is given to using micronized zinc oxide.

A further class of stabilizers for use with preference is that of the fluorescent dyes. They include the 4,4"-diamino-2,2"-stilbenedisulfonic acids (flavone acids), 4,4'-distyrylbiphenyls, methylumbelliferones, coumarins, dihydroquinolinones, 1,3-diarylpyrazolines, naphthalimides, benzoxazole, benzisoxazole and benzimidazole systems, and the pyrene derivatives substituted by heterocycles. Of particular significance in this connection are the sulfonic acid salts of diaminostilbene derivatives, and polymeric fluorescent substances.

In a preferred embodiment, the aforementioned stabilizers are used in any desired mixtures.

Fillers

The storage density of the inventive composition can be adjusted to the specific use by adding fillers. Suitable fillers are selected from the group consisting of sucrose, sucrose esters, sodium sulfate and potassium sulfate. A preferred filler is sodium sulfate.

In a preferred embodiment, the inventive dishwasher detergent comprises 2-10% by weight of component (A), 0.1-5% by weight of component (B), if present 2-10% by weight of component (C), if present 2-10% by weight of component (D), if present 2 to 10% by weight of a polycarboxylate (E), 5 to 40% by weight of component (F) and 1 to 40% by weight of component (G), where the sum of components (A), (B), (C), (D), (E), (F) and (G) adds up to 100% by weight.

The present invention also relates to a process for rinsing surfaces, preferably hard surfaces, especially of cutlery, glasses, dishware and kitchen accessories, by treating these surfaces with the inventive dishwasher detergent.

The surfaces for treatment consist of at least one material selected from the group consisting of ceramic, stoneware, porcelain, wood, plastic, glass and a metal or a metal alloy, for example silver, metal, copper, bronze and/or brass.

The present invention also relates to the use of the inventive dishwasher detergent for increasing the rinsing performance in the machine washing of articles.

EXAMPLES

All examples are carried out with a base formulation of the following compositions:

| | |
|---|---|
| 20% by weight | of methylglycinediacetic acid trisodium salt |
| 30% by weight | of sodium citrate + 5.5 water |
| 25% by weight | of sodium carbonate |
| 6% by weight | of sodium disilicate |
| 15% by weight | of sodium percarbonate |
| 4% by weight | of tetraacetylethylenediamine |

Inventive Surfactants

Example 1

Hexanol+5 EO 408 g of n-hexanol are introduced into a dry 2 l autoclave with 1.5 g of NaOH. The autoclave contents are heated to 150° C., and 880 g of ethylene oxide are injected into the autoclave under pressure. Once the entire amount of ethylene oxide is present in the autoclave, the autoclave is kept at 150° C. for 30 minutes. After cooling, the catalyst is neutralized with acetic acid. The unconverted n-hexanol is distilled off.

The surfactant obtained has a cloud point of 72° C., measured in 1% solution in 5% sodium chloride solution to EN 1890, method B. The surface tension at a concentration of 1 g/l and a temperature of 23° C. is 52.3 mN/m, measured to DIN 53914. The residual n-hexanol content is 0.1% by weight.

Example 2 i-C10 Oxo Alcohol+10 EO+1.5 PeO 395 g of i-$C_{10}$ oxo alcohol are introduced into a dry 2 l autoclave with 1.8 g of NaOH. The autoclave contents are heated to 150° C. and 1100 g of ethylene oxide are injected into the autoclave under pressure. Once the entire amount of ethylene oxide is present in the autoclave, the autoclave is kept at 150° C. for 30 minutes. Subsequently, 322 g of pentene oxide are injected into the autoclave under pressure. Once the entire amount of pentene oxide is present in the autoclave, the autoclave is kept at 150° C. for 180 minutes. After cooling, the catalyst is neutralized with acetic acid.

The resulting surfactant has a cloud point of 38° C., measured in 1% solution in 10% butyl diglycol solution to EN 1890, method E. The surface tension at a concentration of 1 g/l and a temperature of 23° C. is 30.7 mN/m, measured to DIN 53914.

Example 3

C10-C12 Fatty Alcohol+9 EO+5 PO 344 g of C10-C12 fatty alcohol are introduced into a dry 2 l autoclave with 1.5 g of NaOH. The autoclave contents are heated to 150° C. and 580 g of propylene oxide are injected into the autoclave under pressure. Once the entire amount of propylene oxide is present in the autoclave, the autoclave is kept at 150° C. for 30 minutes. Subsequently, 792 g of ethylene oxide are injected into the autoclave under pressure. Once the entire amount of ethylene oxide is present in the autoclave, the autoclave is kept at 150° C. for 180 minutes. After cooling, the catalyst is neutralized with acetic acid.

The resulting surfactant has a cloud point of 70° C., measured in 1% solution in 10% butyl diglycol solution to EN 1890, method E. The surface tension at a concentration of 1 g/l and a temperature of 23° C. is 29.5 mN/m, measured to DIN 53914.

Example 4

In a reactor with nitrogen feed, reflux condenser and metering apparatus, a mixture of 612 g of distilled water and 2.2 g of phosphorous acid is heated to internal temperature 100° C. with supply of nitrogen and stirring. Then, in parallel (1) a mixture of 123.3 g of acrylic acid and 368.5 g of distilled water, (2) a mixture of 18.4 g of sodium peroxodisulfate and 164.6 g of distilled water, (3) a mixture of 72.0 g of water, 49.1 g of methacrylic acid and 166.9 g of methoxypolyethylene glycol methacrylate (Mw=1100) and (4) 46 g of a 40% by weight aqueous sodium hydrogensulfite solution were added continuously within 5 h. After continuing to stir at 100° C. for two hours, the reaction mixture was cooled to room temperature and adjusted to a pH of 7.2 by adding 190 g of 50% by weight sodium hydroxide solution.

A pale yellowish, clear solution of a copolymer with a solids content of 25.7% by weight and a K value of 27.2 (1% by weight aqueous solution, 25° C.) is obtained.

Example 5

In a reactor with nitrogen feed, reflux condenser and metering apparatus, a mixture of 2248 g of distilled water is heated to internal temperature 100° C. with supply of nitrogen and stirring. Then, in parallel (1) a mixture of 767 g of acrylic acid and 1100 g of distilled water, (2) a mixture of 82.2 g of sodium peroxodisulfate and 1092 g of distilled water and (3) 1680 g of methacrylic acid were added continuously within 2.5 h. After continuing to stir at 100° C. for two hours, the reaction mixture was cooled to room temperature at 60° C. and adjusted to a solids content of 25% by adding 2400 g of distilled water. The product has a viscosity (Brookfield LVT, spindle 2, 30 s-1) of 65 mPas.

All rinsing tests are carried out in a Miele G 670 machine dishwasher at 55° C. in the economy program with synthetic calcium-hardened water of 21° dH. No separate rinse aid is added and the water softener installed (ion exchanger) is not regenerated with regenerating salt. The test dishware used in each cleaning cycle was Cromargan knives, black plastic plates (material: ASA), glasses and lids from polyethylene freezer boxes (from EMSA).

After the rinse cycle has ended, this dishware is inspected and assessed for spots, streaks and film-like deposits on a scale ranging from 1 (=severe residues) to 5 (=no residues).

Inventive tests 1 to 4; tests C1, C2 and C3 are comparative tests

| | C1 | C2 | 1 | 2 | C3 | 3 | 4 |
|---|---|---|---|---|---|---|---|
| Base formulation | 19.8 | 19.8 | 19.8 | 19.8 | 19.8 | 19.8 | 19.8 |
| Sodium sulfate | 1.1 | — | — | — | — | — | — |
| Surfactant from example 2 | 1.1 | 1.1 | 1.1 | 0.99 | — | — | — |
| Surfactant from example 3 | — | — | — | — | 1.1 | 1.1 | 1.1 |
| Copolymer from example 4 | — | 1.1 | 0.99 | 0.99 | — | — | — |
| Polymer from example 5 | — | — | — | — | 1.1 | 0.88 | 0.77 |
| Surfactant from example 1 | — | — | 0.11 | 0.22 | — | 0.22 | 0.33 |
| Grading | | | | | | | |
| Knife | 5 | 4.5 | 4.5 | 5 | 4 | 5 | 5 |
| Glass | 2 | 4.5 | 5 | 5 | 4.5 | 5 | 5 |
| Plastic plate | 2.5 | 3 | 4 | 4 | 3.5 | 5 | 5 |
| PE lid | 3.5 | 4.5 | 4 | 4.5 | 4 | 4.5 | 5 |
| Total | 13 | 16.5 | 17.5 | 18.5 | 16 | 19.5 | 20 |

Starting weight in g per cleaning cycle

The invention claimed is:

1. A phosphate-free machine dishwasher detergent composition comprising (A) 0.01-20% by weight of at least one alcohol alkoxylate of the general formula (I)

$$R^1—(OCH_2CHR^2)_x(OCH_2CHR^3)y\text{-}OR^4 \quad (I)$$

where $R^1$: linear or branched $C_6$-$C_{24}$-alkyl radical, $R^2$, $R^3$: different and each independently hydrogen, linear or branched $C_1$-$C_6$-alkyl radical, $R^4$: hydrogen, linear or branched $C_1$-$C_8$-alkyl radical, x, y: each independently mean value in the range of 0.5-80, where the individual alkylene oxide units may be present as a block or in random distribution, (B) 0.01-10% by weight of at least one alcohol ethoxylate of the general formula (II)

$$R^5—(OCH_2CH_2)_zOH \quad (II)$$

where $R^5$: linear or branched $C_4$-$C_8$-alkyl radical and z: mean value of 2-10, where the content of residual alcohol $R^5$—OH is less than 1% by weight, (C) 0-15% by weight of at least one sulfonate-containing polymer, (D) 0.5-12% by weight of at least one hydrophilically modified polycarboxylate, wherein the hydrophilically modified polycarboxylate is a copolymer which comprises alkylene oxide units and is formed from (1) 50 to 93 mol % of acrylic acid and/or of a water-soluble salt of acrylic acid, (2) 5 to 30 mol % of methacrylic acid and/or of a water-soluble salt of methacrylic acid and (3) 2 to 20 mol % of at least one nonionic monomer of the formula VI $$H_2C{=}C(R^{16})—C({=}O)—O—R^{17}—[—R^{18}—O—]_s—R^{19} \quad (VI),$$

in which the variables are each defined as follows:

$R^{16}$ is hydrogen or methyl, $R^{17}$ is a chemical bond or unbranched or branched $C_1$-$C_6$-alkylene, $R^{18}$ are identical or different unbranched or branched $C_2$-$C_4$-alkylene radicals, $R^{19}$ is unbranched or branched $C_1$-$C_6$-alkyl;

s is 3 to 50, where components (1), (2) and (3) are incorporated by random or block copolymerization, (E) 0-8% by weight of at least one polycarboxylate, (F) 1-50% by weight of at least one complexing agent and (G) 0.01-60% by weight of at least one further additive, where the sum of components (A), (B), (C), (D), (E), (F) and (G) is 100% by weight.

2. The composition according to claim 1, wherein, in component (A), $R^1$ is a linear or branched $C_8$-$C_{18}$-alkyl radical, $R^2$ and $R^3$ are each independently hydrogen, methyl, ethyl or propyl, and x and y each independently have a mean value from 0.5 to 20.

3. The composition according to claim 1, wherein component (C) is present and is a copolymer comprising the following monomers (I) 50-98% by weight of one or more weak acids, (II) 2-50% by weight of one or more unsaturated sulfonic acid monomers selected from the group consisting of 2-acrylamidomethyl-1-propane-sulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 3-sulfopropyl methacrylate, sulfomethylacrylamide, sulfomethylmethacrylamide and water-soluble salts thereof, (III) 0-30% by weight of one or more monoethylenically unsaturated $C_4$-$C_8$-dicarboxylic acids and (IV) 0-30% by weight of one or more monoethylenically unsaturated monomers polymerizable with (I), (II) and (III), where the entirety of monomers (I), (II), (III) and (IV) corresponds to 100% by weight of the copolymer.

4. The composition according to claim 1, wherein component (F) used is a complexing agent selected from the group consisting of nitrilotriacetic acid (NIA), methyleneglycinediacetic acid (MGDA), glutaminediacetic acid (GLDA) and mixtures thereof.

5. The composition according to claim 1, wherein the additive is selected from the group consisting of builders, enzymes, bleaches, bleach activators, dyes and fragrances, corrosion inhibitors, antioxidants or UV absorbers, fillers, further surfactants and polymers, extenders and tablet binders.

6. The composition according to claim 1, which comprises 2-10% by weight of component (A), 0.1-5% by weight of component (B), 2-10% by weight of component (C), 2-10% by weight of component (D), 2 to 10% by weight of a polycarboxylate (E), 20 to 55% by weight of component (F) and 1 to 40% by weight of component (G), where the sum of components (A), (B), (C), (D), (E), (F) and (G) adds up to 100% by weight.

7. A process for rinsing hard surfaces of articles comprising treating these surfaces with the composition according to claim 1.

8. The process according to claim 7, wherein the surfaces comprise at least one material selected from the group consisting of ceramic, stoneware, porcelain, wood, plastic, glass, metal and a metal alloy.

9. A method comprising increasing the rinsing performance in the machine washing of articles by the addition of the composition of claim 1.

10. The composition according to claim 1, wherein component (D) is formed from 65 to 85 mol % of component (1), 10 to 25 mol % of component (2) and 5 to 15 mol % of component (3).

11. The composition according to claim 1, wherein component (D) is formed from 65 to 75 mol % of component (1), 15 to 25 mol % of component (2) and 5 to 10 mol % of component (3).

12. The composition according to claim 3, wherein component (C) is a copolymer comprising the following monomers (I) 50-98% by weight of one or more ethylenically unsaturated $C_3$-$C_6$-monocarboxylic acids, (II) 2-50% by weight of one or more unsaturated sulfonic acids, (III) 0-30% by weight of one or more monoethylenically unsaturated $C_4$- to $C_8$-dicarboxylic acids and (IV) 0-30% by weight of one or more monoethylenically unsaturated monomers polymerizable with (I), (II) and (III), where the entirety of monomers (I), (II), (III) and (IV) corresponds to 100% by weight of the copolymer.

13. The composition according to claim 3, wherein component (C) is a copolymer comprising the following monomers (I) 50-90% by weight of one or more ethylenically unsaturated $C_3$-$C_6$-monocarboxylic acids, (II) 10-50% by weight of unsaturated sulfonic acid, (III) 0-30% by weight of one or more monoethylenically unsaturated $C_4$-$C_8$-dicarboxylic acids and (IV) 0-30% by weight of one or more monoethylenically unsaturated monomers polymerizable with (I), (II) and (III), where the entirety of monomers (I), (II), (III) and (IV) corresponds to 100% by weight of the copolymer.

14. The composition according to claim 3, wherein component (C) is a copolymer comprising the following monomers (I) 60-90% by weight of one or more ethylenically unsaturated $C_3$-$C_6$-monocarboxylic acids, (II) 10-40% by weight of the unsaturated sulfonic acid, (III) 0-30% by weight of one or more monoethylenically unsaturated $C_4$-$C_8$-dicarboxylic acids and (IV) 0-30% by weight of one or more monoethylenically unsaturated monomers polymerizable with (I), (II) and (III), where the entirety of monomers (I), (II), (III) and (IV) corresponds to 100% by weight of the copolymer.

* * * * *